US007280010B2

(12) United States Patent
Buer et al.

(10) Patent No.: US 7,280,010 B2
(45) Date of Patent: Oct. 9, 2007

(54) DIELECTRIC RESONATOR RF INTERCONNECT

(75) Inventors: Kenneth V. Buer, Gilbert, AZ (US); David Laidig, Mesa, AZ (US)

(73) Assignee: U.S. Monolithics, L.L.C., Gilbert, AZ (US)

( * ) Notice: Subject to any disclaimer, the term of this patent is extended or adjusted under 35 U.S.C. 154(b) by 82 days.

(21) Appl. No.: 10/907,425

(22) Filed: Mar. 31, 2005

(65) Prior Publication Data

US 2006/0220766 A1 Oct. 5, 2006

(51) Int. Cl.
*H01P 7/10* (2006.01)
*H01P 1/00* (2006.01)

(52) U.S. Cl. ..... 333/219.1; 333/260

(58) Field of Classification Search ..... 333/219.1, 333/227, 254, 260

See application file for complete search history.

(56) References Cited

U.S. PATENT DOCUMENTS 4,560,965 A * 12/1985 Gosling et al. ..... 333/202
6,072,378 A * 6/2000 Kurisu et al. ..... 333/219.1
6,104,261 A * 8/2000 Sonoda et al. ..... 333/202
6,538,526 B2 * 3/2003 Mikami et al. ..... 333/24 R

* cited by examiner

*Primary Examiner*—Robert Pascal
*Assistant Examiner*—Kimberly E Glenn
(74) *Attorney, Agent, or Firm*—Shell & Wilmer L.L.P.

(57) ABSTRACT

A RF interconnect comprising a dielectric resonator is disclosed. The dielectric resonator may be included in an interconnect housing. The dielectric resonator includes metalized side surfaces useful for securing the dielectric resonator in an aperture formed in the interconnect housing. The dimensions or material selected for the dielectric resonator may be predetermined to enable the dielectric resonator to operate as a filter or waveguide, as desired.

12 Claims, 5 Drawing Sheets

DIELECTRIC RESONATOR RF INTERCONNECT

FIELD OF INVENTION

The invention relates to a system and method for RF interconnects, and more particularly a system and method for a connectorless RF interconnect.

BACKGROUND OF INVENTION

Active antenna arrays are expected to provide performance improvements and reduce operating costs of communications systems. An active antenna array includes an array of antenna elements. In this context, the antenna element may be viewed as being a transducer which converts between free-space electromagnetic radiation and guided waves. In an active antenna array, each antenna element, or a subgroup of antenna elements, is associated with an active module. The active module may be a low-noise receiver for low-noise amplification of the signal received by its associated antenna element(s), or it may be a power amplifier for amplifying the signal to be transmitted by the associated antenna element(s). The active modules, in addition to providing amplification, ordinarily also provide amplitude and phase control of the signals traversing the module to point the beam(s) of the antenna in the desired direction. In some arrangements, the active module also includes filters, circulators, and/or other functions.

Carefully designed interconnects are needed to transmit a RF signal between two electronic modules or assemblies, such as printed circuit boards. In high-powered RF electronics applications, including RF power amplifiers for cellular base stations, a relatively high amount of energy is transmitted through the interconnect. Signal attenuation may occur as a result of radiation of energy into the air or reflections caused by the signal transfer properties of the interconnect. Therefore, one important characteristic of interconnect assemblies is good signal transfer properties with minimal signal attenuation. Other important characteristics are low cost and ease of manufacture.

Known prior art interconnects are generally mechanical interconnects requiring some form of mechanical coupling to ensure proper RF signal transmission. Conventional methods of constructing interconnects include using blind mate connector systems, metal ribbon connections, and printed circuit pin and spring socket systems. Each of these approaches has shortcomings which include bulkiness in size, the need for manual labor which increases costs, difficulty in manufacturing, and insufficient shielding.

One prior art interconnect that has gained popularity is known as a "Gilbert"™ contact, which consists of a male pin that is soldered or brazed to the next level assembly. The mating contact is a female pin which opens up to allow a male pin to slide into it. Although widely accepted by the industry, it requires a pin to be soldered or brazed at the next level of interconnect, which increases the overall cost of the system.

Another typical example of a prior art interconnect is described in U.S. Pat. No. 4,957,456. The '456 patent describes a self-aligning blind mate RF push-on connector. One problem with the connector described in the '456 patent is its bulkiness, which makes the connector unsuitable for systems with space limitations.

Therefore, a need exists for a RF interconnect that reduces signal attenuation and costs associated with the prior mechanical interconnects. It would therefore represent an advance in the art to provide a RF connector which does not require any special mating provisions except for a pad area.

SUMMARY OF INVENTION

The present invention addresses many of the shortcomings found in the prior art, especially in the area of RF interconnects. In one aspect, the present invention uses a dielectric resonator in the RF interconnect. The invention takes advantage of the characteristics of dielectric resonators to have very low dielectric loss at microwave frequencies, and to provide small controllable temperature coefficients of the resonance frequency over a useful operating range. The invention teaches a RF interconnect that includes a dielectric resonator that does not use mechanical couplings.

In another aspect, the invention uses the dielectric resonator in a RF interconnect to provide filtering properties. The resonance frequency of the dielectric resonator interconnect is controllable by pre-selecting the dielectric resonator material. In this way, the dielectric resonator may be configured to provide filtering properties as desired.

In yet another aspect, the invention uses a dielectric resonator in a RF interconnect as a dielectric loaded circular waveguide. That is, the invention may be used to guide electromagnetic waves by preconfiguring, for example, the cross-sectional dimensions of the dielectric resonator interconnect, the type of dielectric material inside the dielectric resonator interconnect, and the frequency of the circuit.

In one particular embodiment, the RF interconnect disclosed includes a dielectric resonator disposed between two circuit elements of an antenna array. The dielectric resonator provides a low loss pathway for providing RF signals between the two circuit elements. For example, the dielectric resonator may place an element and a microstrip, two microstrips, or two circuit elements in communication.

BRIEF DESCRIPTION OF THE DRAWINGS

The accompanying drawings, wherein like numerals depict like elements, illustrate exemplary embodiments of the present invention, and together with the description, serve to explain the principles of the invention. In the drawings.

DETAILED DESCRIPTION

The present invention provides a connectorless RF interconnect including a metalized dielectric resonator. Dielectric resonators are commonly used in filters, oscillators and other electronic devices. Although different forms of dielectric resonators are commercially available, the dielectric resonators that are most often used have the form of a short circular straight-wall cylinder which may have or may not have an axially-extending hole in the center of the cylinder and a length-to-radius ratio which is often close to one.

Figure 1:
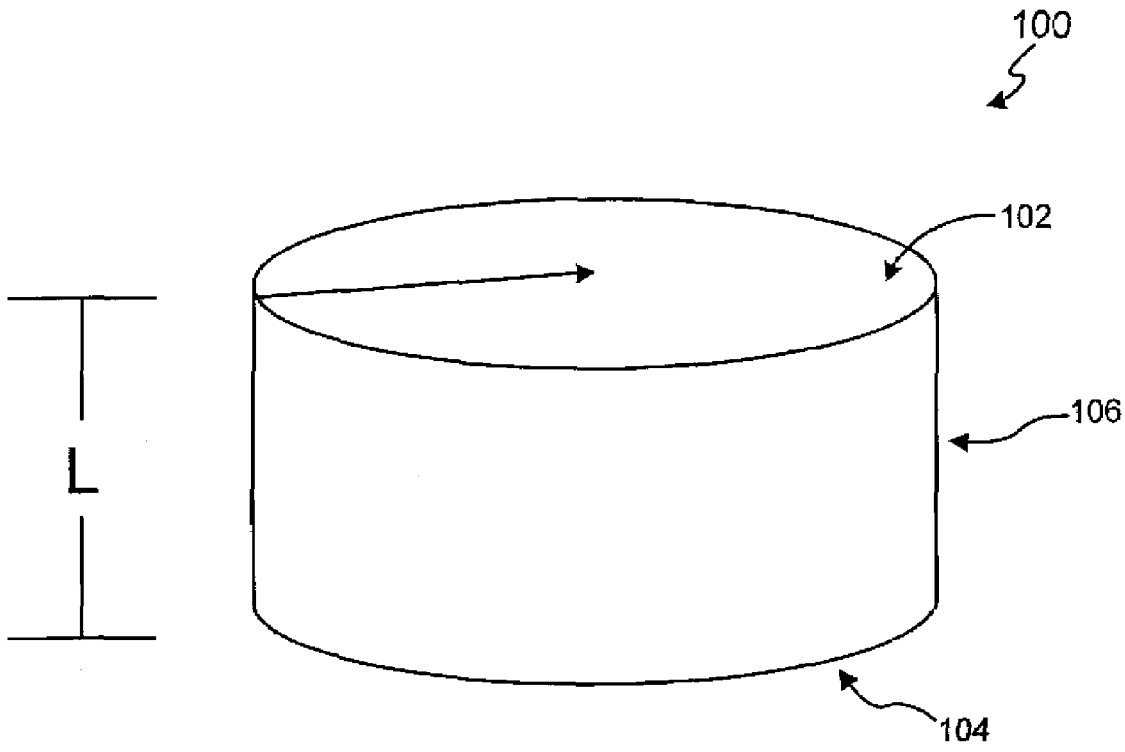
FIG. 1 is an exemplary depiction of a prior art dielectric resonator useful with the present invention.

FIG. 1 illustrates an exemplary dielectric resonator ("DR") DR 100 useful with the present invention. DR 100 is of the short circular straight-wall cylinder type, having a first substantially planar circular upper surface 102 and a second substantially planar circular bottom surface 104. Upper surface 102 and bottom surface 104 are joined by a cylindrical straight-wall side surface 106. As shown, the radius r of the upper surface 102 (and the radius r of the bottom surface 104) may be in one to one ratio relationship with the length L of the cylindrical straight-wall side surface 106.

In one exemplary embodiment of the invention, DR 100 is metalized on a portion of cylindrical straight-wall side surface 106. In this context "metalized" means that side surface 106 is coated with a thin metal film that is useful for bonding side surface 106 to another surface. Suitable metal films which are useful with the invention include gold, silver, tin, lead, nickel, copper or any other metal permitting DR 100 to be affixed to another surface.

Figure 2:
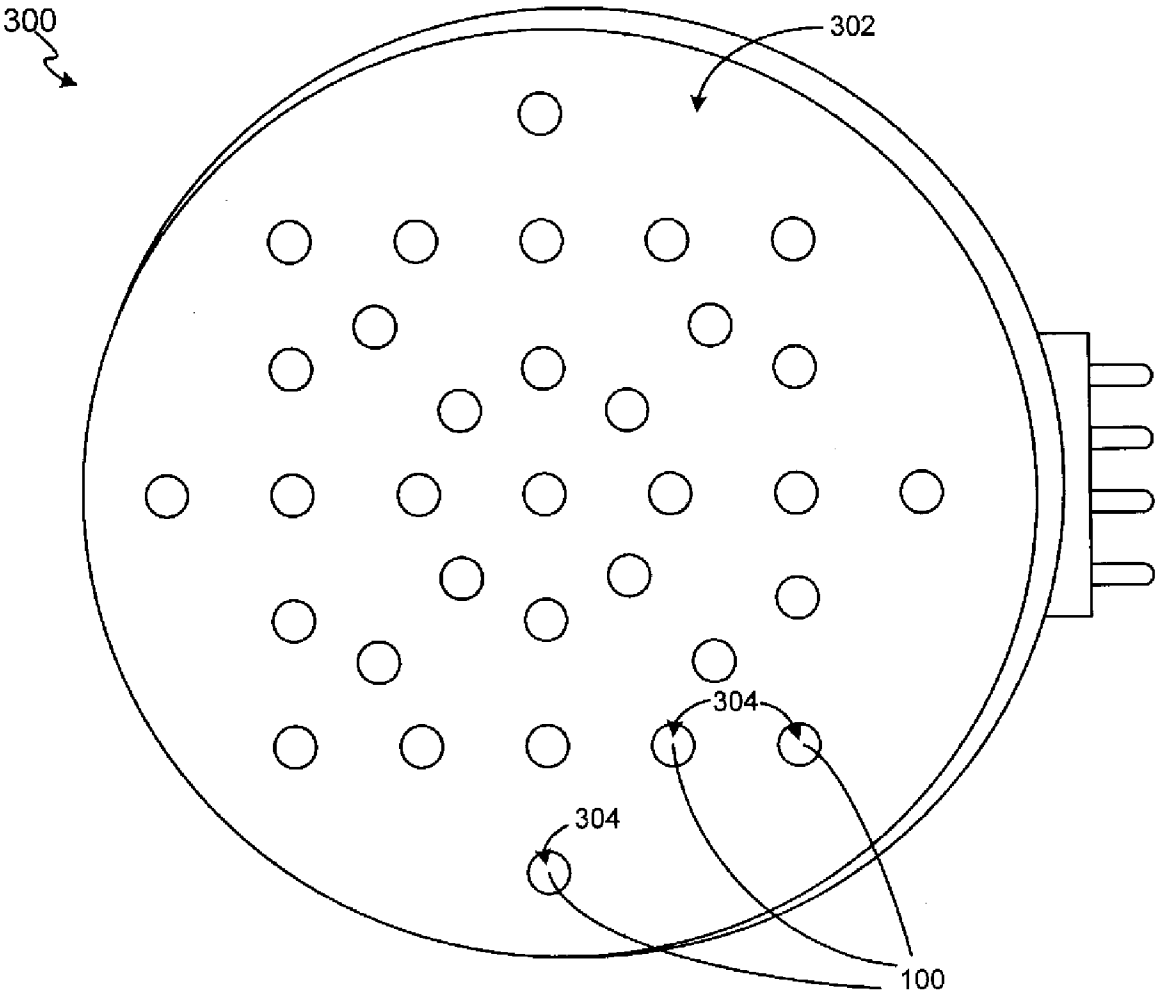
FIG. 2 is a depiction of an exemplary RF interconnect housing useful with the present invention.

For coupling DR 100 to a transmission line, DR 100 may be interposed within an interconnect housing. FIG. 2 depicts a suitable interconnect housing 300 useful with the present invention. In general, interconnect housing 300 may be any structure capable of supporting the connection of one electrical component to another electrical component, which additionally aids in the transmission of RF signals therebetween. Exemplary interconnect housing may be a metal, ceramic, Teflon or other material suitable for electronic or microwave circuit enclosures. Interconnect housing 300 may be any housing capable of supporting DR 100 such that DR 100 may receive and/or transmit RF signals from one electrical circuit element to another. Interconnect housing 300 is configured to receive and fix DR 100 in a location for enabling RF transmission. As such, interconnect housing 300 may be composed of any material providing suitable rigidity for holding DR 100 in place. Additionally, interconnect housing 300 may have a first surface 302 which may be planar, conical or other suitable shape facilitating connection of DR 100 to electrical components. Alignment features such as alignment pins or optical alignment targets as are known may be added to the surface 302 of the interconnector housing 300 to a RF interface discussed below.

In some instances, it may be desired to transmit one or more RF signals to a plurality of electrical components. In that regard, interconnect housing 300 may be operable to receive and fix a plurality of DR 100. In such an instance, a plurality of DR 100 may be in communication with a plurality of electrical components. For example, interconnect housing 300 is depicted having a first surface 302 having a plurality of interconnect locations 304 for receiving a plurality of DR 100. In this instance, each interconnect location 304 is configured to receive a DR 100 and fix DR 100 for use in transmitting a RF signal.

The metalized DR 100 may be affixed to interconnect housing 300 using conventional solder conductive or non-conductive epoxy or other suitable affixing agent, operable to provide structural support and/or to hermetically seal DR 100 in interconnect housing 300. The solder may be placed on the RF interconnect housing 300 in the interconnect location 304 for eventual placement of DR 100. To aid in holding DR 100 in a fixed position, interconnect location 304 may be a recess suitably shaped for receiving DR 100. DR 100 may be positioned inside the recess such that upper surface 102 and bottom surface 104 are in communication with an electrical circuit element. Upon being positioned inside or at interconnect location 304, the DR 100 is held in a fixed position using any one of the affixing agents noted above. DR 100 may be placed at the RF interconnect location 304 using any conventional machine or robot useful for fixing circuit components for a RF interconnect.

Figure 3:
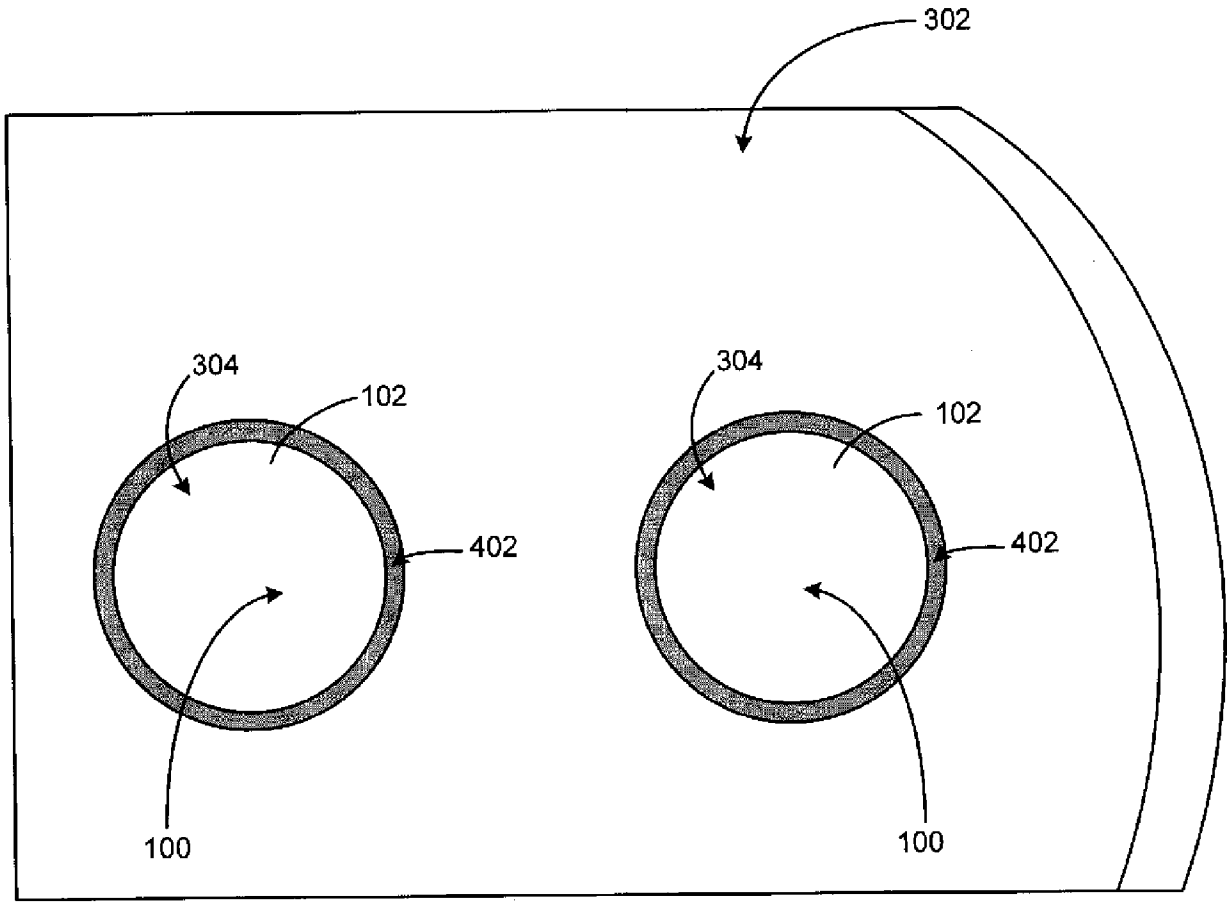
FIG. 3 is a depiction of portion of an exemplary RF interconnect housing useful with the present invention.

FIG. 3 depicts a closer view of DR 100 positioned at interconnect location 304 showing DR 100 held in place. As shown, DR 100 is affixed at interconnect location 304 using a suitable affixing agent 402. In the example shown, interconnect housing 300 includes a substantially planar surface 302 such that surface 302, DR 100 and upper surface 102 are substantially in the same plane. In one exemplary embodiment, upper surface 102 may be parallel to planar surface 302, but upper surface 102 may lie in a different plane than planar surface 302.

The diameter of interconnect location 304 may be slightly greater than the diameter of upper surface 102 such that DR 100 may be positioned inside interconnect location 304. In one exemplary embodiment, the diameter of interconnect location 304 may be substantially similar to the diameter of upper surface 102, such that DR 100 may be positioned in interconnect location 304 with application of minimal force along the axial direction to interconnect location 304.

As shown, the affixing agent 402 may be positioned between the perimeter of interconnect location 304 and the perimeter of upper surface 102. In one exemplary embodiment, the affixing agent 402 may be positioned abutting side wall 106 prior to positioning DR 100 at interconnect location 304. In another exemplary embodiment, the affixing agent 402 may be positioned in a recess formed at interconnect location 304 prior to positioning DR 100 at interconnect location 304. In yet another exemplary embodiment, DR 100 may be positioned at interconnect location 304 prior to positioning the affixing agent 402 in proximity to DR 100 and interconnect location 304.

Figure 4:
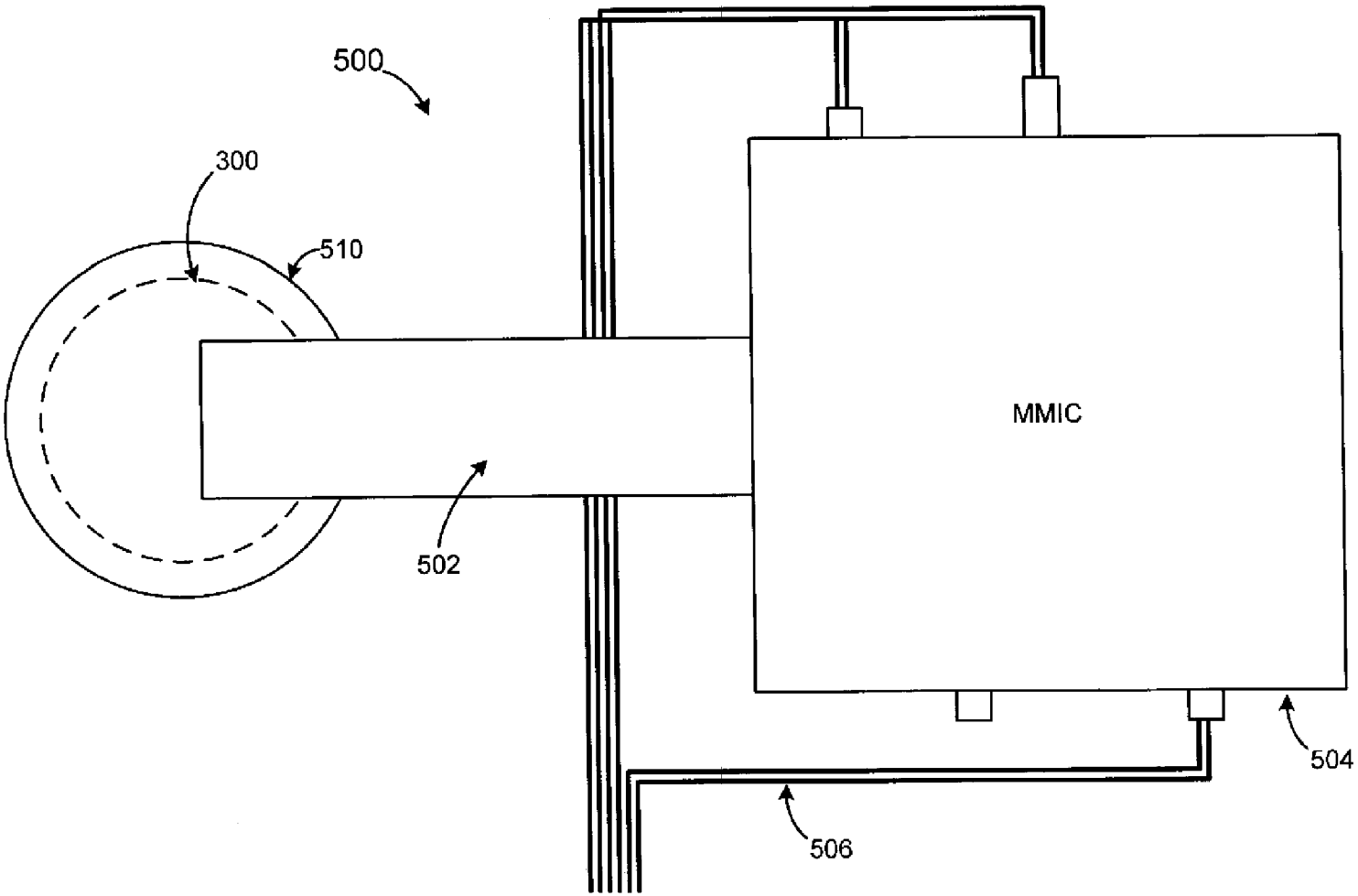
FIG. 4 is a depiction of an exemplary circuit in which the present invention may be used.

With brief reference to FIG. 4, the interconnect housing 300, is illustrated as a filter and is shown in the ordinary environment in which it may be found. Interconnect housing 300 may be used in any conventional circuit requiring a RF interconnect and filtering. As illustrated, interconnect housing 300, including DR 100, is depicted providing filtering with respect to a MMIC 504, via a microstrip 502. Microstrip 502 is configured to place MMIC 504 in electrical communication with DR 100, as described below. In this instance, where a plurality of DR 100 are used, the plurality DR 100 shown in FIG. 2, are installed in circuit 500 with the upper surface 102 of the plurality of DR 100 in electrical contact with microstrip 502 via RF interface 510. In this regard, interconnect housing 300 is depicted as being hidden from view by RF interface 510 (interconnect housing 300 shown in broken lines in FIG. 4, underlying RF interface 510).

Interconnect housing 300 is in electrical communication with a RF interface 510, which is in electrical communication with microstrip 502, which is in electrical communication with MMIC 504, as described more fully below. MMIC 504 may be in further contact with later circuitry (not shown) via conductors 506 for providing and receiving signals therefrom.

Although the circuit 500 is depicted as having RF interface 510, microstrip 502, and MMIC 504, the circuit 500 may include any circuit elements as are well known to use RF interconnects. Thus, microstrip 502, MMIC 504, and conductors 506 may be any conventional similar elements.

Figure 5:
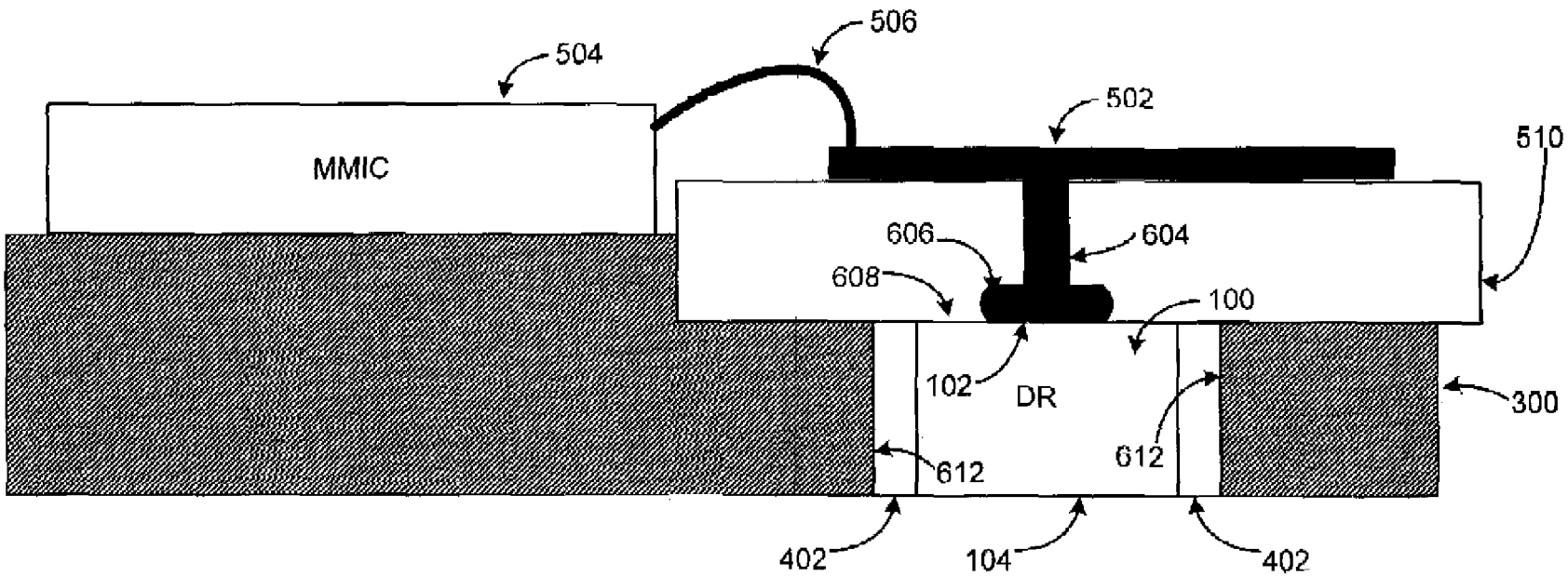
FIG. 5 is an exemplary depiction a cross-sectional view of circuit in which the present invention may be used.

Referring now to FIG. 5, DR 100 is shown used as a RF interconnect in the exemplary circuit 500. More particularly, FIG. 5 depicts a portion of FIG. 4 in cross-section, wherein filter housing 300 connects with microstrip 502, and wherein a single one of the plurality of DR 100 is shown in electrical communication with microstrip 502. Conductors 506 may be in communication with MMIC 504 for providing biasing and control signals thereto. Microstrip 502 may send RF signals to DR 100 via conductors 506. As shown, interconnect housing 300 includes a recess 608 for including DR 100. The dimensions of the recess 608 may be chosen to closely follow the dimensions of DR 100. In the example shown, DR 100 is substantially cylindrical in shape. Thus, recess 608 is depicted as being substantially cylindrical in shape such that the recess generally follows the shape of the DR 100. Additionally, recess 608 may include recess side walls 612 configured to closely follow the shape of DR 100. Moreover, in one exemplary embodiment, the dimensions of recess 608 are such that DR 100 may be securely fitted within recess 608. In another exemplary embodiment, like the one depicted in FIG. 5, recess 608 is dimensionally slightly larger than DR 100. More particularly, recess 608 is of sufficient size that free space may be included between DR 100 and the recess side walls 612. The free space may be sufficient for including an affixing agent 402. In some instances, it is desirable to hermetically seal the DR 100 within filter housing 300. In this regard, DR 100 may be fixed in recess 608 using a paste, such as, for example, solder in similar manner as described above. The affixing agent 402 may be positioned in recess 608 for holding DR 100 in position. Additionally, the upper surface 102 of DR 100 is exposed so that it may be placed contact with later circuitry, described below.

RF interface 510 may include a transmission path 604 in communication with microstrip 502 for transmitting signals between the microstrip 502 and DR 100. Transmission path 604 may include a planar pad of conducting material 608, which is placed in substantial contact with the upper surface 102 of DR 100. Notably, although the conducting material 608 is described as planar, conducting material 608 may be configured as desired to effectuate communication with upper surface 102. In this way, signals may be transmitted between DR 100 and microstrip 502, via the pad of conducting material 608 and the transmission path 604.

DR 100 may be configured as a filter as described above, by pre-selecting the dimensions and composition of DR 100. Thus, in operation, DR 100 may be configured to provide filtering at a predetermined resonance. Methods for selecting the dimensions and composition of dielectric resonators is well known, and any conventional method may be used.

Circuit 500 may receive a signal at filter housing 300 and provide the signal to DR 100. DR 100 may filter the signal and provide the signal to microstrip 502 via pad 606 and transmission line 604. Microstrip 502 may then provide the signal to MMIC 504 or some other suitable connected circuit element.

In another exemplary embodiment, DR 100 may be used as a waveguide in a waveguide structure. To configure DR 100 for use in a waveguide structure, the dimensions of DR 100 may be chosen to allow electromagnetic propagation but not cavity resonance, as is done with the filtering interconnect The present invention has been described above with reference to various exemplary embodiments. However, those skilled in the art will recognize that changes and modifications may be made to the exemplary embodiments without departing from the scope of the present invention. For example, the various operational steps, as well as the components for carrying out the operational steps, may be implemented in alternate ways depending upon the particular application or in consideration of any number of cost functions associated with the operation of the system (e.g., various of the steps may be deleted, modified, or combined with other steps). Alternatively, additional steps (e.g., solder paste placement steps) may be added to illustrate alternate embodiments of the invention. In addition, the various circuit component placement systems disclosed herein may be modified or changed to accommodate additional pucks or circuit components as may be desired. The changes and/or modifications described above are intended to be included within the scope of the present disclosure, as set forth in the following claims.

What is claimed is:

1. A system comprising a dielectric resonator, the system further comprising a RF interconnect housing for securing said dielectric resonator, said housing comprising a housing recess, said dielectric resonator being disposed within said housing recess, said dielectric resonator being held fixed in said recess, wherein said dielectric resonator is configured to operate as a RF interconnect between circuit elements.

2. A system of claim 1, wherein said dielectric resonator is hermetically sealed within said housing recess.

3. A system of claim 2, wherein said hermetic sealing is done using an affixing agent.

4. A system of claim 1, wherein said dielectric resonator is operable as a waveguide.

5. A system of claim 1, wherein said dielectric resonator is operable as a RE filter.

6. The system according to claim 1, wherein the system is capable of operating as a connection between circuit elements, without utilizing mechanical couplings between the circuit elements.

7. A method for configuring a dielectric resonator RF interconnect comprising:

a. metalizing a portion of a side surface of a dielectric resonator;

b. inserting the dielectric resonator in an interconnect housing aperture; and c. securely fixing the dielectric resonator in said interconnect housing aperture, wherein the metalized surface is operable to securely affix said dielectric resonator in said interconnect housing aperture, and wherein said dielectric resonator is configured to operate as a RF interconnect between circuit elements.

8. The method of claim 7, further comprising placing the dielectric resonator adjacent circuit elements to allow a non-mechanical signal connection between the circuit elements.

9. The RF interconnect according to claim 7, wherein said dielectric resonator is further capable of operating as a waveguide.

10. The RF interconnect according to claim 7, wherein said dielectric resonator is further capable of operating as a filter.

11. The RF interconnect according to claim 7, wherein the RF interconnect is capable of operating as a signal connection between circuit elements, without utilizing mechanical couplings between the circuit elements.

12. A RF interconnect device, comprising:

a first RF interconnect assembly, and a second RF interconnect assembly, wherein the first and the second RF interconnect assemblies each comprise a plurality of dielectric resonators;

wherein the plurality of dielectric resonators of said first RF interconnect assembly are located in a first interconnect housing, wherein the plurality of dielectric resonators of said second RF interconnect assembly are located in a second interconnect housing;

wherein said first and second RF interconnect assemblies are configured to facilitate an alignment of pairs of individual dielectric resonators, each pair comprising one dielectric resonator from said first RF interconnect assembly and one dielectric resonator from said second RF interconnect assembly, wherein said first and second interconnect housings are further configured to facilitate said alignment; and wherein said plurality of dielectric resonators are configured to operate as a RF interconnect between circuit elements.

* * * * *

UNITED STATES PATENT AND TRADEMARK OFFICE

CERTIFICATE OF CORRECTION

PATENT NO. : 7,280,010 B2
APPLICATION NO. : 10/907425
DATED : October 9, 2007
INVENTOR(S) : Kenneth V. Buer et al.

It is certified that error appears in the above-identified patent and that said Letters Patent is hereby corrected as shown below:

Column 6, line 25, the letters "RE" should be replaced with the letters --RF-- in claim 5.

Signed and Sealed this

Twenty-fifth Day of December, 2007

JON W. DUDAS
*Director of the United States Patent and Trademark Office*